US005582574A

United States Patent [19]

Cramer

[11] Patent Number: 5,582,574

[45] Date of Patent: Dec. 10, 1996

[54] HYPERBARIC INCUBATION METHOD

[76] Inventor: Frederick S. Cramer, 208 Oregon St., Kellogg, Id. 83837

[21] Appl. No.: 409,985

[22] Filed: Mar. 24, 1995

[51] Int. Cl.[6] ..... A61G 10/00

[52] U.S. Cl. ..... 600/21; 128/205.26

[58] Field of Search ..... 600/21–22; 128/897–98, 128/205.26

[56] References Cited

U.S. PATENT DOCUMENTS

| | | | |
|---|---|---|---|
| Re. 34,077 | 9/1992 | Segall et al. . | |
| 2,700,384 | 1/1955 | Ivory | 128/205.26 |
| 3,158,150 | 11/1962 | Croasdaile . | |
| 3,547,118 | 12/1970 | Kolman | 128/205.26 |
| 3,889,670 | 6/1975 | Loveland et al. . | |
| 4,296,743 | 10/1981 | Lasley . | |
| 5,084,011 | 1/1992 | Grady . | |
| 5,207,639 | 5/1993 | Cooper . | |
| 5,218,958 | 6/1993 | Cooper . | |
| 5,308,310 | 5/1994 | Roff et al. . | |
| 5,336,616 | 8/1994 | Livesey et al. . | |

FOREIGN PATENT DOCUMENTS

| | | | |
|---|---|---|---|
| 9218084 | 10/1992 | WIPO | 602/21 |

*Primary Examiner*—Angela D. Sykes
*Assistant Examiner*—John P. Lacyk
*Attorney, Agent, or Firm*—Douglas E. White; Acronational Law Firm

[57] ABSTRACT

A pressurized container is filled with pure oxygen. The apparatus, and the method of treatment provided thereby, are able to deliver oxygen to the blood of an enclosed premature neonate by means of directly diffusing molecular oxygen through the unusually permeable skin of such infants. Hyperbaric pressure, i.e., pressure substantially above one atmosphere absolute (ATA), preferably at least two ATA, is maintained in the container, which facilitates the transcutaneous delivery of oxygen to the blood. Means are included for protecting the eyes of the neonate and for performing physiological ventilation of the lungs thereof. The provision of normal tissue oxygen tensions facilitates the neurological development of the infant, thereby enhancing its long term quality of life.

21 Claims, 1 Drawing Sheet

HYPERBARIC INCUBATION METHOD

FIELD OF THE INVENTION

This invention relates to a hyperbaric apparatus and a method of treatment for supporting the life of a premature neonate suffering from the risks and problems associated with oxygenation via undeveloped lungs.

BACKGROUND OF THE INVENTION

Premature infants possess in varying degrees, undeveloped lungs. Very low birth weight infants ("neonates") with undeveloped lungs cannot obtain enough blood oxygen on their own and often suffer from complications such as bronchopulmonary dysplasia (BPD), pulmonary edema and respiratory distress syndrome. These are phenomena occurring when the immature lung does not have the ability to maintain the lung air sacs in an open position due to the lack of surfactant, which coats the inner lung that captures oxygen. Sometimes the lungs become flooded with fluid. In addition, the lung cells do not have adequate defense mechanisms in place to deal with the toxic effect of oxygen in the inspired air.

Bronchopulmonary dysplasia is the abnormal growth or development of the bronchial tubes and the lungs. Presently, there is no suitable treatment for chronic BPD.

Respiratory distress syndrome is caused by a deficient secretion of surfactant from alveolar cells. This lining may not be present in the lung of a premature infant. Without adequate surfactant, the infant will have difficulty breathing normally. Adults can be cured with surfactant therapy, which is the administration of animal surfactant (typically porcine) to the airways. However, surfactant therapy is less effective in neonates, particularly those with respiratory failure caused by factors other than, or in addition to, surfactant deficiency.

Pulmonary edema is caused by a seepage of fluid into the air sacs of the lungs and into the tissue forming the framework of the lungs. The lungs become swollen, resulting in a shortness of breath and congestion.

Presently, the preferred form of treatment for the above-mentioned complications is to intubate the premature infant, i.e., to apply mechanical ventilation apparatus that forces oxygen through tubes leading through its throat to its lungs. With such ventilation, the low birth weight premature infant can obtain limited oxygen. This invasive mechanical procedure is frequently the only treatment for infants with undeveloped lungs.

However, when an infant's lungs are forcibly ventilated under the present form of treatment, the infant is introduced to medical complications that jeopardize its life or long-term health. Also, in some cases where premature neonates are mechanically ventilated, they become dependent on the mechanical ventilation for survival.

Many of these premature neonates with undeveloped lungs contract and suffer from chronic disease or in some cases, suffer death, due to the limitations of prior art treatment methods and apparatuses for augmenting blood oxygenation. On the other hand, without assistance of mechanical ventilation, the undeveloped lung is unable to properly oxygenate the infant's blood, as noted above. This is likely to cause, if not death, serious neurological deficits in the infant's growth and development—an unacceptable alternative.

There has long been a need felt in the medical community to eliminate the risks and problems of mechanical ventilation of premature or low birth weight infants associated with the present treatment art. All the following conditions, diseases or syndromes are known risks associated with the present art that need to be minimized or eliminated. These disorders or conditions are caused by lung exposure to high doses of oxygen and other side effects of the current treatments, and can lead to serious mortality and complication rates in prematurely born infants.

Bronchiolitis, the acute inflammation of the bronchioles is one known side effect of existing methods of neonatal oxygen therapy. If the bronchioles are inflamed, the passage of air is blocked between the windpipe and the lungs and breathing is thereby complicated.

Both lung and other organ damage are caused by hyperoxia. Hyperoxia is a condition in which the blood carries more than the usual amount of oxygen. It is caused by the inhalation of pure oxygen. The risks and problems of the prior art associated with infant hyperoxia are commonly known to those in the medical profession.

Central nervous system damage and pulmonary oxygen toxicity are caused by prolonged exposure to oxygen when a patient is mechanically ventilated. Pulmonary oxygen toxicity is a condition where the lungs are poisoned because they are saturated with above normal concentrations of oxygen.

Retinopathy is caused by exposure to high concentrations of oxygen. It is a disease of the retina or the innermost, image-receiving wall of the eyeball.

Intraventricular brain hemorrhaging and seizures are other common complications that effect premature neonates that are mechanically ventilated.

It is not disputed that present treatment methods help a large percentage of neonates with undeveloped lungs. However, many other premature infants are not cured or helped and still others have their health impaired by the side effects of such treatment. Medical literature suggests that there is a great need tier an effective alternative to the unnecessary infant disease and death caused or exacerbated by these invasive mechanical ventilation procedures, which contribute to pulmonary oxygen toxicity. Despite progress in this field, low birth weight infants continue to suffer serious neurological deficits in growth and development.

Heretofore unrelated to the treatment of premature infants is the field known as hyperbaric medicine or hyperbaric oxygen therapy. This is the use of intermittent, high dose (100%) pressurized oxygen breathing to treat certain diseases which are characterized by a relative tissue hypoxia (under-oxygenation). For example, hyperbaric medicine is used in the treatment of problem wounds. In the present hyperbaric art, the oxygen breathing must be intermittent, since high doses of oxygen are toxic to both the lung and the brain, as noted above, even in adults.

In conventional hyperbaric medicine, oxygen is delivered to the blood through the lungs, as opposed to through the skin. Problem wound healing is promoted by dissolving oxygen in the blood under pressure (which pressure allows it to contain higher oxygen concentrations than normal). This is done to the point where the partial pressure of oxygen in the blood becomes very greatly elevated. The induced partial pressure differential causes increased amounts of oxygen to escape into the wound tissue at adjacent capillaries. Thus, oxygen is delivered to the wound internally, rather than transcutaneously. The oxygen is administered at a high dose by enclosing the entire patient in an airtight chamber and increasing the pressure to two to three times the normal atmospheric pressure. The duration of treatment typically is once or twice daily for one to two hours.

Heretofore, hyperbaric concepts have not been applied to the field of neonatal medicine. Indeed, conventional thinking would suggest that such would be particularly inappropriate, insofar as the breathing of high dosage oxygen is largely what causes the problems discussed above. However, with modifications discussed herein, it is submitted that hyperbaric principles can be adapted to the avoidance of oxygen and other ventilation damage to neonatal lungs.

Prior developments in this field may be generally illustrated by reference to the following information disclosure statement:

| U.S. Pat. No. | Patentee | Issue Date |
|---|---|---|
| 5,207,639 | W. Cooper | May 4, 1993 |
| 5,308,310 | T. Roff et al. | May 3, 1994 |
| 5,218,958 | W. Cooper | Jun. 15, 1993 |
| 4,296,743 | R. Lasley | Oct. 27, 1981 |
| 3,889,670. | S. Loveland et al. | Jun. 17, 1975 |
| 5,336,616 | S. Livesey et al. | Aug. 9, 1994 |
| Re. 34,077 | P. Segall et al. | Sep. 22, 1992 |
| 5,084,011 | D. Grady | Jan. 28, 1992 |
| 3,158,150 | F. Croasdaile | Nov. 24, 1962 |

U.S. Pat. No. 5,207,639 teaches a device for oxygenating the blood of a non-breathing prematurely born baby via its umbilical cord.

U.S. Pat. No. 5,308,310 teaches a plethysmograph system for monitoring the respiration of neonates. It features an air-tight transparent acrylic case which is able to withstand at least some internal air pressure increase of unstated quantity. The pressure changes discussed therein appear solely caused by the natural and/or mechanically-induced respiration of the infant.

U.S. Pat. No. 5,218,958 teaches a life support system for a premature baby that supplies oxygen and nutrients to the child. An air-tight upper chamber contains 100% oxygen which is supplied to the infant via its still-connected placenta.

U.S. Pat. Nos. 4,296,743 and 3,889,670 teach hyperbaric devices. The former may be modified to provide oxygen treatment to any portion of the patient's body except the head. The latter is a hyperbaric ventilator that fits on the head only. Both operate at pressures of 50 pounds per square inch, which is about 3 atmospheres absolute (ATA).

U.S. Pat. No. 5,336,616, U.S. Pat. No. Re. 34,077 and U.S. Pat. No. 5,084,011 teach oxygenating blood and tissue and, along with U.S. Pat. No. 3,158,150, are representative of what is in the art.

SUMMARY OF THE INVENTION

The purpose of this invention is to provide for the oxygenation of the blood of premature, low birth weight, infants without subjecting the immature lungs thereof to high concentrations of oxygen, which concentrations are known to be toxic. The risks and problems associated with oxygenation via the undeveloped lung in the premature infant are well understood, as discussed above.

It is also known, however, that the skin (dermis) of the neonate is unusually permeable to the diffusion of environmental gases, in particular, to oxygen. This is markedly different from the normal adult skin which is distinctly non-permeable to oxygen. In fact, the dermis is relatively hypoxic under normal adult conditions, even in high concentrations of environmental oxygen.

The present invention is a pressurized container filled with pure or nearly pure oxygen. The apparatus is able to deliver oxygen directly to the blood of a neonate by means of diffusing the oxygen through the unusually permeable skin of such infants. Hyperbaric pressure, i.e., above one ATA, preferably two ATA or higher, is maintained in the container, which facilitates the transcutaneous delivery of oxygen. Means are included for protecting the eyes of the neonate and for performing physiological ventilation of the lungs.

The device of the present invention, and its method of use, will provide tissue oxygenation by the direct diffusion of molecular oxygen through the skin of the premature neonate. The provision of normal tissue oxygen tensions will facilitate the neurological development of the infant, thereby enhancing long term quality of life.

FEATURES AND ADVANTAGES

An object of this invention is to disclose a method of oxygenating the blood of a premature infant comprising the step of applying oxygen to the skin of the infant at hyperbaric pressure.

Another object is to disclose the step of enclosing the infant in a hyperbaric chamber.

A further object or feature is the step of protecting the eyes of the infant with an oxygen barrier.

Yet another feature is intubating the infant with an endotracheal tube operably connected to a pediatric ventilator.

A preferred feature of the invention is applying the oxygen at a pressure of two atmospheres absolute or higher.

Additional features include the steps of attaching a pulse oximeter to the infant; attaching at least one EKG patch to the infant; attaching a urine drainage catheter and attaching an IV access line to the infant.

Yet another such feature is attaching a transcutaneous oxygen pressure monitor to the infant. Still another is attaching an umbilical catheter to the infant for blood sampling.

A preferred feature is that the endotracheal tube supplies the infant with oxygen at a concentration of less than 20 percent.

Another preferred feature is that the oxygen is applied to the skin at a concentration of at least 95 percent.

An object is to disclose a hyperbaric chamber or incubator for premature infants that has penetration channels for admitting wires or tubes for monitoring the infant or providing life support to the infant.

Another object or feature of the chamber is a wheeled bed for the infant, the bed being able to be rolled into and out of the chamber.

Another feature is that the provided hyperbaric chamber has a cylindrical body constructed substantially out of transparent plastic. Preferably, the body is double-walled.

Yet another ligature of the hyperbaric incubator chamber is control panel means on the exterior thereof for monitoring and controlling the interior environment of the apparatus.

Another feature is an apparatus that is easy to use, safe in operation, and suitable for production at a relatively low cost.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and will not be limiting For example, words such as "upwardly," "downwardly," "leftward," and "rightward" would refer to directions in the drawings to which reference is made unless otherwise stated. Similarly, words such as "inwardly" and "outwardly" would refer to directions toward and away from, respectively, the geometric center of a device or area and designated parts thereof. References in the singular tense include the plural, and vice versa, unless otherwise noted.

Figure 1:
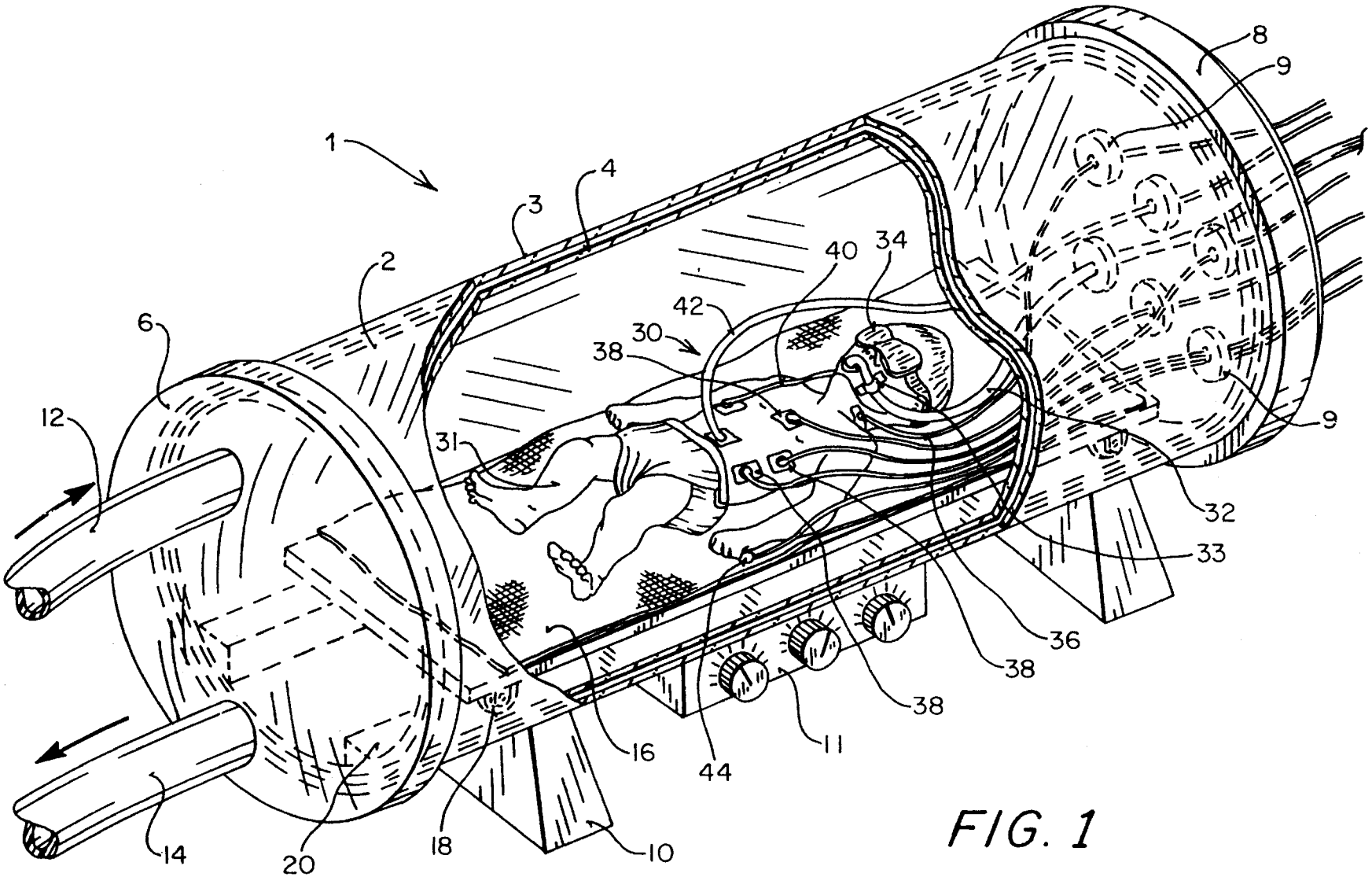
FIG. 1 is a broken perspective view of a preferred hyperbaric incubator of this invention, schematically illustrated.

| Drawing Reference Numerals | |
|---|---|
| 1 | hyperbaric incubator |
| 2 | cylinder |
| 3 | outer wall |
| 4 | inner wall |
| 6 | fixed end |
| 8 | door |
| 9 | penetration channels |
| 10 | stand |
| 11 | control panel |
| 12 | oxygen intake tube |
| 14 | waste gas exhaust tube |
| 16 | bed |
| 18 | wheels |
| 20 | track |
| 30 | neonate |
| 31 | dermis |
| 32 | endotracheal tube |
| 33 | bandage |
| 34 | eye patch |
| 36 | IV access line |
| 38 | EKG patches |
| 40 | transcutaneous oxygen pressure monitor |
| 42 | umbilical catheter |
| 44 | pulse oximeter patch |

DESCRIPTION OF A PREFERRED EMBODIMENT

Referring to FIG. 1, there is schematically illustrated therein a hyperbaric chamber or incubator 1 of this invention. The hyperbaric incubator 1 generally is comprised of a highly pressure-resistant, largely transparent cylinder 2 having a fixed seal 6 at one end and a hinged pressure door 8 at the other. The cylinder 2, and perhaps substantial portions of the ends 6 and 8, are made from a suitable hard polymer plastic such as that sold under the trademark PLEXIGLAS. Preferably, the cylinder 2 and the plastic portions of the ends 6 and 8 are double-walled, i.e. they have a outer wall 3 and a closely-spaced inner wall 4. The thin outer wall 3 acts as an emergency back-up safety shell in the unlikely event of a pressure leak or rupture of the inner wall 4. In general, the hyperbaric incubator 1 will be constructed to meet standards which are well-accepted in the production of adult, monoplace hyperbaric chambers.

A plurality of pressure-retaining penetration channels 9 are formed through the door 8, with which to guide tubes and wires from inside the incubator 1 to separate external supply and monitoring apparatus (not illustrated). The door is held onto the cylinder by suitable vertical hinges (also not illustrated) of conventional type which allow it to swing open sideways. A pressurized oxygen intake tube 12 is located on the fixed end 6 of the cylinder 2, along with an exhaust tube 14 for removing waste gases, such as carbon dioxide, water vapor, and the like.

Schematically illustrated in FIG. 1 are a stand 10 for the apparatus and a control panel 11 for effecting apparatus-specific internal environmental monitoring and control over temperature, humidity, and the like, in the manner of standard incubators. Patient-specific monitoring and life-support are accomplished by conventional external apparatus (not illustrated) connected to the neonate 30 through the penetrations 9 in the door 8. Unlike existing incubators, however, the control panel 11 of the hyperbaric incubator 1 will incorporate means for elevating the pressure of the cylinder 2 to hyperbaric levels (i.e., levels substantially in excess of one ATA).

A bed 16 travels on wheels 18 or the like along tracks 20, for granting quick and convenient access to a premature neonate 30. The entire hyperbaric incubator 1 normally will rest on a movable cart or table, for the convenience of the medical and nursing staff.

Although oxygen will be delivered transcutaneously under pressure by the hyperbaric incubator 1, as described below, the patient 30 will be intubated with an endotracheal tube 32 or the like. The tube 32 is held in place by a suitable patch or bandage 33 and leads to a pediatric ventilator with hyperbaric modification. Such a ventilator will deliver low dosage oxygen (preferably 20% or lower) and/or inert gas (such as nitrogen), and might even be used to ventilate the neonate 30 with liquids--such as a liquid duplicating the constituency of the amniotic fluid which circulates through the embryo's lungs while in utero.

Though some mechanical ventilation will be needed for physiological reasons (the neonate will naturally breathe after birth, and needs to do so), minimization of oxygen delivery through the lungs through use of the present invention will eliminate most, if not all, of the complications introduced by high-dose oxygen as practiced in the present art. The concept is that once the lungs are not required to oxygenate the blood of the infant, the lungs can be perfused or oxygenated in a manner both to protect the delicate tissues thereof, as well as to encourage their normal growth and maturation.

To prevent retinopathy and corneal complications known to occur in the presence of high oxygen concentrations, the eyes of the neonate 30 will be covered by an eye patch 34 or other suitable oxygen barrier.

As is conventional in the art, an intravenous (IV) access line 36 provides fluids and nourishment to the neonate 30, preferably through the neck area. An umbilical catheter 42 performs a similar delivery function for medicines and the like.

A plurality of EKG patches 38 will be used for heart monitoring. A pulse oximeter patch 44 leads to pulse oximeter equipment for monitoring blood oxygen and pulse rate. A transcutaneous oxygen pressure monitor 40 will be used for measuring blood oxygen.

OPERATION

Upon determination that a premature neonate 30 has an impaired ability to oxygenate blood due to such birth complications as bronchopulmonary dysplasia, pulmonary edema, respiratory distress syndrome or the like, the neonate 30 is placed on the bed 16 of the hyperbaric incubator 1. Suitable monitoring wires and life support tubes are fed through the penetration channels 9, such as an endotracheal tube 32, an IV access line 36, EKG patches 38, a transcutaneous oxygen pressure monitor 40, an umbilical catheter 42, and a pulse oximeter patch 44, and the like. These are connected to the neonate 30 in the accepted manner. An eye patch 34 and other apparatus for protecting sensitive areas from overexposure to oxygen are also provided, as discussed above.

The neonate 30 will need to remain in the incubator 1 for long periods at a time. Therefore, the diaper shown in FIG. 1 for purposes of illustration normally will not be used. Rather, a standard urine catheter (not illustrated) will be attached to the genital area of the neonate. Insofar as the neonate will be nourished intravenously, it will not delicate.

The bed 16 is rolled into the cylinder 2 and the hinged door 8 is sealed. Pure oxygen is tied into the cylinder 2 via the oxygen intake tube 12. Alternatively, a mixture of oxygen and other gas is introduced. However, in all cases, the oxygen content of the hyperbaric incubator 1 is elevated far above normal infant incubator levels—greater than 95% in most cases.

The pressure inside the hyperbaric incubator 1 is then raised to hyperbaric levels. Therapeutic pressures generally will range from two ATA ("atmospheres absolute", one ATA being 14.7 pounds per square inch) and up. However, pressures in the hyperbaric incubator 1 of less than two ATA may also be used. Furthemore, the pressure may be varied from one level to another during the course of treatment, as the lung matures. The pressure and oxygen content of the interior of the cylinder 2 will be adjusted to maintain an adequate (normal) oxygen saturation of the hemoglobin of the neonate 30.

Gas pressure and other environmental factors internal to the cylinder 2 are controlled through the control panel 11.

With the oxygen pressure in the cylinder 2 raised to hyperbaric levels, a steep gradient is established across the exposed dermis 31 of the neonate 30 with respect to the partial pressure of oxygen. Within and under the dermis, a similar gradient is established across the wails of blood vessels, and, finally, across the cell walls of blood erythrocytes. This will cause molecular oxygen to diffuse or migrate through the dermis to the hemoglobin, whereupon the hemoglobin will be oxygenated directly, with little or no intervention of the underdeveloped lungs of the neonate 30.

The neonate's lungs are needed little, if at all, during the treatment method of the present invention. It remains physiologically necessary, however, regularly to inflate and deflate the lungs. Therefore, gas with low oxygen concentrations (at the level of free air or below), or oxygen-free inert gases, or even amniotic fluid-like liquids, will be pumped into and out of the endotracheal tube 32. To the extent beneficial, small amounts of oxygen might be introduced through the endotracheal tube 32 to augment the hyperbaric oxygenation described above, particularly as the kings of the neonate 30 mature during treatment. However, it will be possible with the hyperbaric transcutaneous-oxygenation apparatus and treatment method of the present invention either to do away with or so greatly reduce the amount of harmful lung oxygenation as to eliminate or minimize the complications and morbidity presently associated with the treatment of low birth weight premature infants.

While the above provides a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like. As just one example, the preferred hyperbaric incubator is approximately 30 inches or more in length and approximately 18 inches in diameter. However, it is known to practice hyperbaric medicine within hyperbaric "chambers" the size of large rooms which may contain several patient beds and be large enough for both patients and medical staff The method of the present invention is capable of being practiced in such hyperbaric chambers. Therefore, the above description and illustrations should not be construed as limiting the scope of the invention, which is defined by the appended claims.

What is claimed is:

1. A method of oxygenating the blood of a premature infant having skin and lungs, comprising the steps of:

enclosing the infant in a hyperbaric chamber;

applying oxygen at a concentration of at least 95 percent to the skin of the infant at a pressure of at least 2 atmospheres absolute; and ventilating the lungs of the infant with liquid or gas having an oxygen concentration of less than 20 percent.

2. The method of claim 1 further comprising the step of:

protecting the eyes of the infant with an oxygen barrier mask.

3. The method of claim 2 further including at least one of the steps of:

attaching a pulse oximeter to the infant;

attaching at least one EKG patch to the infant;

attaching a urine drainage catheter to the infant;

attaching a transcutaneous oxygen pressure monitor to the infant;

attaching an umbilical catheter to the infant; or attaching an IV access line to the infant.

4. A method of oxygenating the blood of a premature infant having skin and lungs, comprising the steps of:

enclosing the infant in a hyperbaric chamber;

measuring the level of blood oxygen of the infant; and adjusting the measured level of blood oxygen of the infant transcutaneously by applying oxygen to the skin of the infant at hyperbaric pressure.

5. The method of claim 4 further comprising the steps of:

intubating the infant with an endotracheal tube; and supplying fluid having an oxygen concentration to the lungs of the infant through the tube.

6. The method of claim 5 further comprising the step of:

maintaining the measured level of blood oxygen of the infant at a predetermined acceptable level by increasing the pressure in the chamber and decreasing the concentration of oxygen in the fluid, whereby the incidence of disorders of the lungs of the infant, including pulmonary oxygen toxicity, is decreased.

7. The method of claim 6 wherein:

the oxygen is applied to the skin at a pressure of at least 2 atmospheres absolute.

8. The method of claim 7 wherein:

the fluid supplied through the endotracheal tube is a gas having an oxygen concentration of substantially zero.

9. The method of claim 5 wherein:

the fluid supplied through the endotracheal tube is a gas having an oxygen concentration of less than 20 percent.

10. The method of claim 5 wherein:

the fluid supplied through the endotracheal tube is a liquid substantially duplicating the constituency of amniotic fluid.

11. The method of claim 6 further comprising the step of:

protecting the eyes of the infant with an oxygen barrier.

12. The method of claim 6 wherein:

the oxygen is applied to the skin at a concentration of at least 95 percent.

13. The method of claim 12 further comprising the steps of:

attaching a pulse oximeter to the infant and monitoring the infant's blood oxygen therewith;

attaching at least one EKG patch to the infant and monitoring the infant's heart rhythm therewith; and attaching an IV access line to the infant and intravenously administering fluids to the infant therewith.

14. The method of claim 13 further comprising the steps of:

attaching a transcutaneous oxygen pressure monitor to the infant and measuring the infant's tissue oxygenation therewith;

attaching a urine drainage catheter to the infant and allowing the infant's urine to drain therefrom; and attaching an umbilical catheter to the infant and sampling the blood of the infant and delivering medicine to the infant therewith.

15. The method of claim 4 further comprising the step of:

providing the hyperbaric chamber with penetration channels for admitting wires or tubes for monitoring the infant or providing life support to the infant.

16. The method of claim 4 further comprising the step of:

providing the hyperbaric chamber with a wheeled bed for rolling the infant into and out of the chamber.

17. The method of claim 4 further comprising the steps of:

providing control panel means on the exterior of the hyperbaric chamber for monitoring and controlling an interior environment thereof; and providing the hyperbaric chamber with a cylindrical body constructed substantially out of double-walled transparent plastic for viewing the infant.

18. A method of oxygenating the blood of a premature infant having skin and lungs, comprising the steps of:

enclosing the infant in a hyperbaric chamber;

measuring the level of blood oxygen of the infant;

adjusting the level of blood oxygen of the infant transcutaneously by applying oxygen to the skin of the infant at hyperbaric pressure; and achieving an adequate level of blood oxygen of the infant by adjusting the pressure in the chamber.

19. The method of claim 18 further comprising the steps of:

supplying fluid to the lungs of the infant, the fluid having an oxygen concentration; and achieving the adequate level of blood oxygen of the infant by increasing the pressure in the chamber and decreasing the concentration of oxygen supplied to the infants lungs, whereby the incidence of disorders of the lungs of the infant, including pulmonary oxygen toxicity, is decreased.

20. The method of claim 19 further comprising the step of:

providing the fluid with an oxygen concentration so low as to cause substantially all oxygen to be delivered to the blood of the infant through the infant's skin.

21. The method of claim 19 wherein:

the fluid supplied to the lungs has an oxygen concentration of less than 20 percent;

the oxygen is applied to the skin at a pressure of at least 2 atmospheres absolute; and the oxygen is applied to the skin at a concentration of at least 95 percent.

* * * * *